US011837772B2

(12) United States Patent
Patel

(10) Patent No.: US 11,837,772 B2
(45) Date of Patent: Dec. 5, 2023

(54) MODULES FOR CELLULAR BASE STATIONS AND BRACKET ASSEMBLIES FOR MOUNTING SAME

(71) Applicant: CommScope Technologies LLC, Hickory, NC (US)

(72) Inventor: Jignesh Patel, Plano, TX (US)

(73) Assignee: COMMSCOPE TECHNOLOGIES LLC, Claremont, NC (US)

( * ) Notice: Subject to any disclaimer, the term of this patent is extended or adjusted under 35 U.S.C. 154(b) by 0 days.

(21) Appl. No.: 17/687,043

(22) Filed: Mar. 4, 2022

(65) Prior Publication Data

US 2022/0311122 A1 Sep. 29, 2022

Related U.S. Application Data

(60) Provisional application No. 63/165,948, filed on Mar. 25, 2021.

(51) Int. Cl.
*H01Q 1/12* (2006.01)
*H01Q 1/24* (2006.01)

(52) U.S. Cl.
CPC ..... *H01Q 1/1242* (2013.01); *H01Q 1/12* (2013.01); *H01Q 1/24* (2013.01); *H01Q 1/246* (2013.01)

(58) Field of Classification Search
CPC ..... H01Q 1/1242; H01Q 1/246; H01Q 1/12; H01Q 1/24
USPC ..... 343/892
See application file for complete search history.

(56) References Cited

U.S. PATENT DOCUMENTS

| | | | | |
|---|---|---|---|---|
| 2017/0264005 | A1 | 9/2017 | Roy et al. | |
| 2017/0324154 | A1* | 11/2017 | Hendrix | H01Q 1/42 |
| 2019/0058239 | A1 | 2/2019 | Smith | |
| 2020/0388907 | A1* | 12/2020 | Colapietro | H01Q 1/246 |
| 2020/0411945 | A1 | 12/2020 | Heath et al. | |
| 2021/0321486 | A1 | 10/2021 | Mirza et al. | |
| 2021/0328337 | A1 | 10/2021 | Gienger et al. | |
| 2021/0336331 | A1 | 10/2021 | Rai et al. | |

FOREIGN PATENT DOCUMENTS

| | | |
|---|---|---|
| CN | 204538179 U | 8/2015 |
| KR | 20100034351 A | 4/2010 |

OTHER PUBLICATIONS

"International Search Report and Written Opinion corresponding to International Application No. PCT/2022/019085 dated Jun. 23, 2022".

* cited by examiner

*Primary Examiner* — Hai V Tran
(74) *Attorney, Agent, or Firm* — Myers Bigel, P.A.

(57) ABSTRACT

An antenna-RRU module for a cellular base station includes first, second and third antenna-RRU assemblies mounted on a pole. Each of the first, second and third antenna-RRU assemblies includes: a pole mounting bracket; a subassembly mounting bracket mounted on the pole mounting bracket; an antenna-RRU unit fixed relative to the subassembly mounting bracket; and a shroud mounted to at least partially cover the antenna-RRU unit. The pole mounting brackets of the first, second and third antenna-RRU assemblies are mounted on the pole at approximately 120 degree intervals.

20 Claims, 15 Drawing Sheets

MODULES FOR CELLULAR BASE STATIONS AND BRACKET ASSEMBLIES FOR MOUNTING SAME

RELATED APPLICATION

The present application claims priority from and the benefit of U.S. Provisional Patent Application No. 63/165,948, filed Mar. 25, 2021, the disclosure of which is hereby incorporated herein by reference in full.

FIELD OF THE INVENTION

The present application is directed generally toward antennas, and more particularly to mounting structures for antennas.

BACKGROUND

As wireless data service demands have grown, a conventional response has been to increase the number and capacity of conventional cellular Base Stations (Macro-Cells). The antennas used by such Macro-Cells are typically mounted on antenna towers. A conventional antenna tower has three or four legs on which antennas and supporting remote radio units (RRUs) are mounted. However, in some environments structures known as "monopoles" are used as mounting structures. Monopoles are typically employed when fewer antennas/RRUs are to be mounted, and/or when a structure of less height is required.

Macro-Cell sites are becoming less available, and available spectrum limits how much additional capacity can be derived from a given Macro-Cell. Accordingly, small cell RRU and antenna combinations have been developed to "fill in" underserved or congested areas that would otherwise be within a Macro-Cell site. Deployment of small cells, particularly in urban environments, is expected to continue to grow. Often such small cell configurations (sometimes termed "Metrocells") are mounted on monopoles. Typically, these small cell configurations do not permit mounting of other equipment above the antenna.

In some instances, metrocells may be mounted on existing structures, such as buildings, billboards, kiosks, and the like. See, e.g., U.S. Patent Publication No. 2017/0324154 to Hendrix e al. and U.S. Patent Publication No. 2020/0411945 to Heath et al., each of which is hereby incorporated herein by reference in full. In addition, metrocells may be mounted on streetlight poles and the like. See, e.g., U.S. Patent Publication No. 2021/0328337 to Gienger et al., the disclosure of which is hereby incorporated herein in full by references.

When metrocells are deployed in environments where aesthetic appearance is important (or even dictated by local regulation), the components of the metrocell (e.g., antennas and RRUs) may be concealed from view via external housings and the like. As such, designs have been developed to conceal these components. One exemplary design is shown in FIG. 1, in which an assembly 100 includes a luminaire arm 12 that supports a luminaire 14, an RRU module 15 and an antenna module 16. It can be seen that the RRU and antenna modules 15, 16 are largely concealed and do not extend radially outwardly from the exterior of the underlying pole 10. However, as the configurations and sizes of antennas and RRUs also vary between manufacturers and also change over time, techniques for concealing these components may also require new designs. Thus, it may be desirable to provide additional metrocell concealment arrangements.

SUMMARY

As a first aspect, embodiments of the invention are directed to an antenna-RRU assembly. The assembly comprises: an antenna-RRU unit; a subassembly mounting bracket fixed relative to the antenna-RRU unit, the subassembly mounting bracket having a plurality of hooks; and a pole mounting bracket having a plurality of slots. The hooks of the subassembly mounting bracket are inserted into the slots of the pole mounting bracket to mount the subassembly mounting bracket to the pole mounting bracket.

As a second aspect, embodiments of the invention are directed to an antenna-RRU module for a cellular base station. The module comprises first, second and third antenna-RRU assemblies mounted on a pole, each of the first, second and third antenna-RRU assemblies comprising: a pole mounting bracket; a subassembly mounting bracket mounted on the pole mounting bracket; an antenna-RRU unit fixed relative to the subassembly mounting bracket; and a shroud mounted to at least partially cover the antenna-RRU unit. The pole mounting brackets of the first, second and third antenna-RRU assemblies are mounted on the pole at approximately 120 degree intervals.

DETAILED DESCRIPTION

Figure 1:
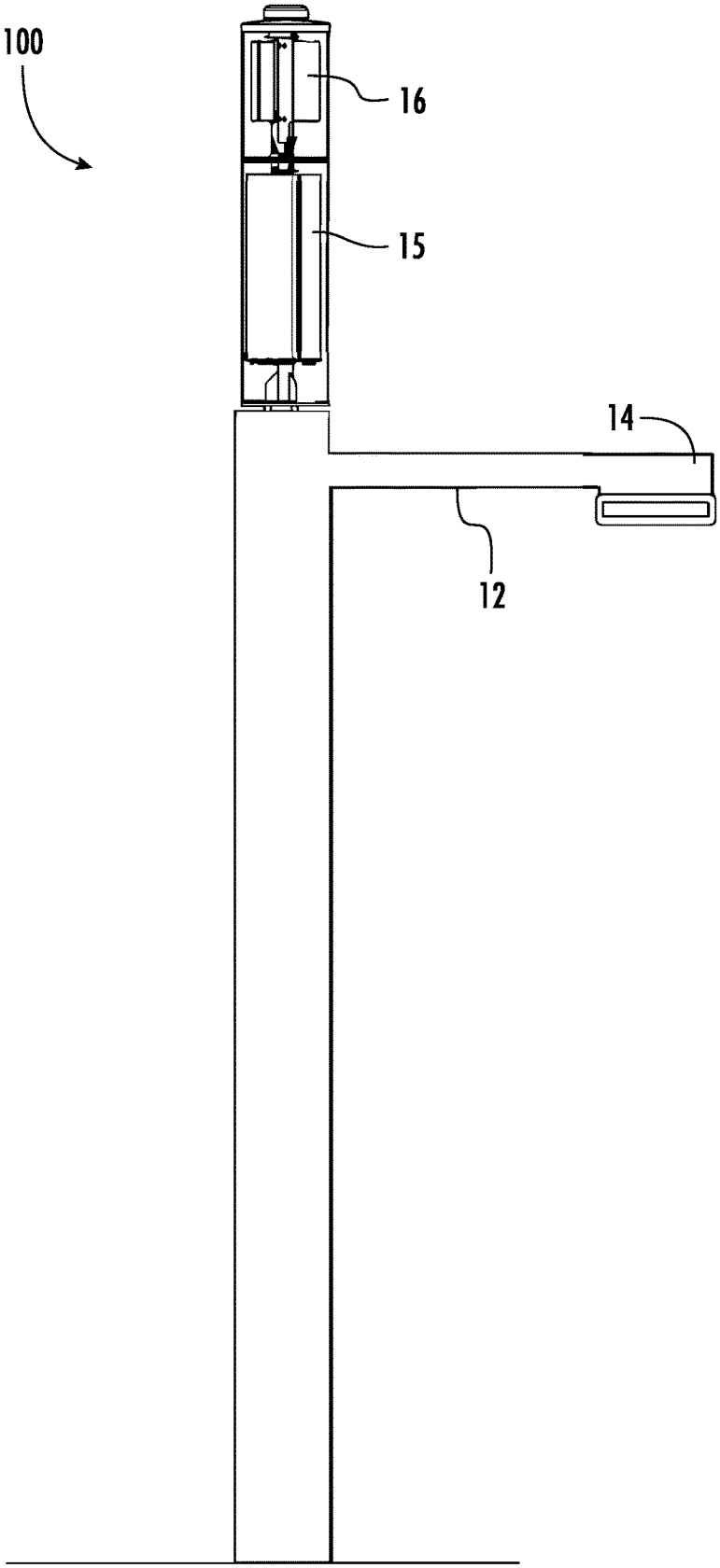
FIG. 1 is a front view of an exemplary monopole with a luminaire attached and an antenna module mounted thereon.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the figures, certain layers, components or features may be exaggerated for clarity, and broken lines illustrate optional features or operations unless specified otherwise. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Figure 2:
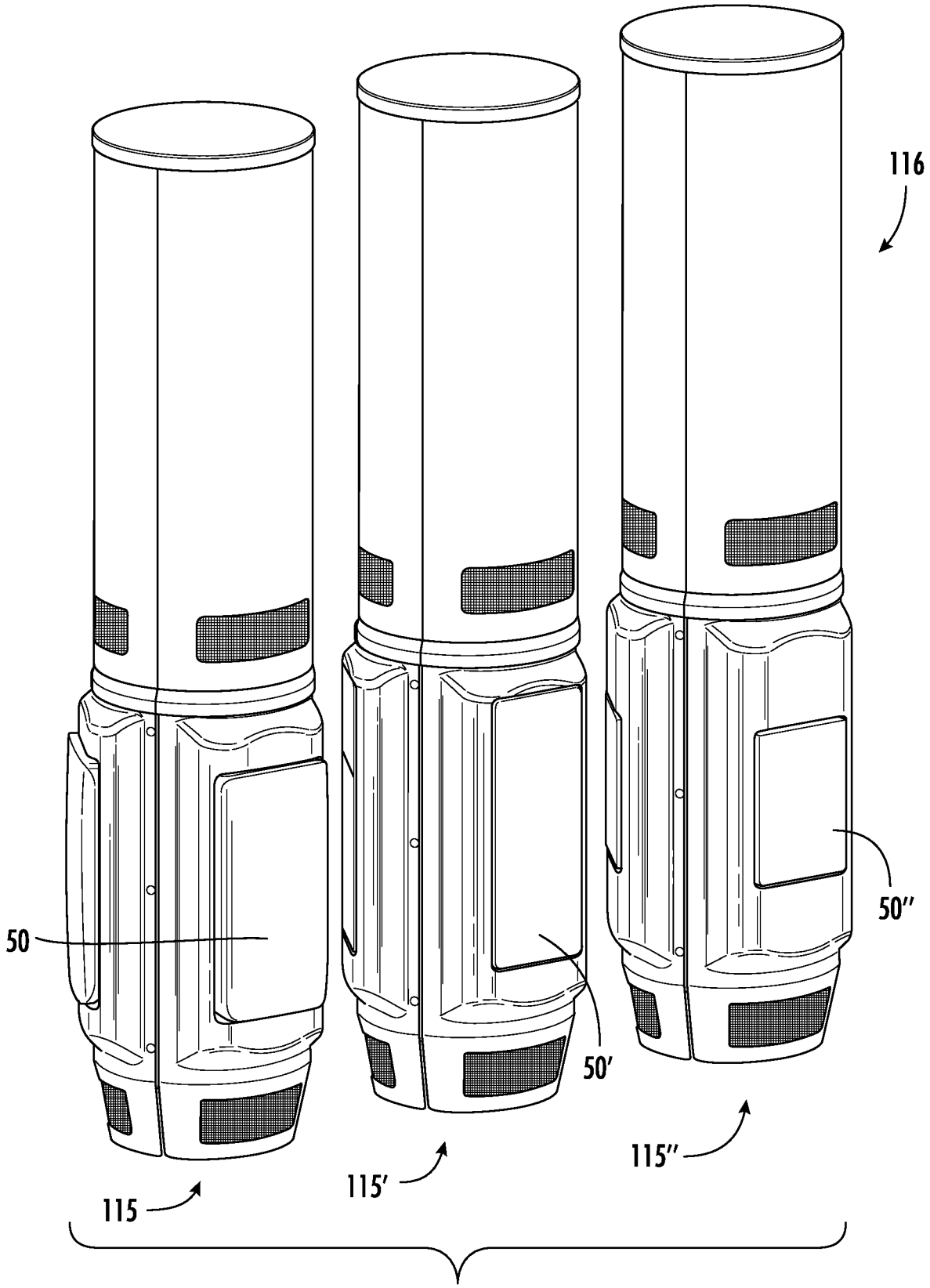
FIG. 2 is a perspective view of three antenna and antenna-RRU modules similar to those shown in FIG. 1 and according to embodiments of the invention, with three different antenna-RRU units employed in the antenna-RRU modules.
Figure 6A:
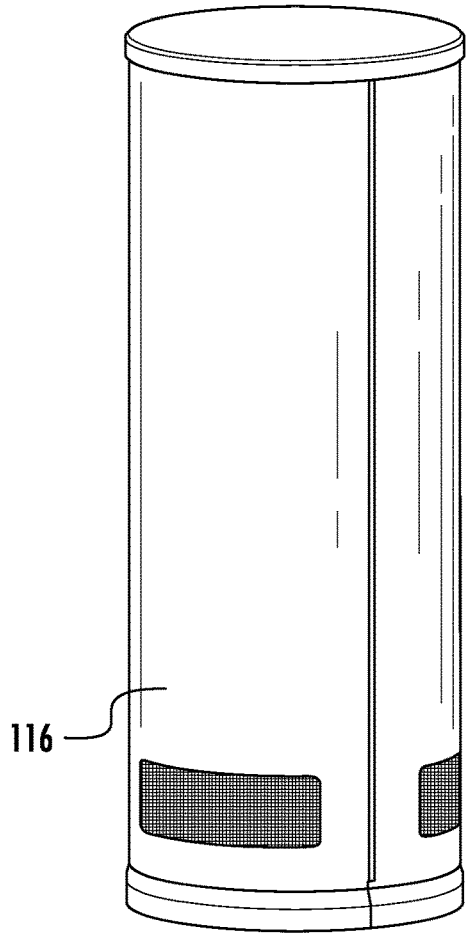
FIG. 6A is a perspective view of an antenna module of FIG. 2.

Referring now to the drawings, FIG. 2 illustrates a series of three assemblies, each of which includes an antenna module 116 mounted atop a respective antenna-RRU module 115, 115', 115". The antenna module 116 (also shown in FIG. 6A) may be of any number of different configurations known to house antennas. In some embodiments, the antenna module 116 may house passive antennas (typically "4G" antennas) that are connected with radios that are mounted elsewhere on the monopole (e.g., below one of the antenna-RRU modules 115, 115', 115"). Exemplary antenna modules 116 are discussed in, for example, U.S. Patent Publication Nos. 2020/0388907, 2021/0321486, and 2021/0336331, the disclosure of each of which is incorporated herein by reference in full.

The antenna-RRU modules 115, 115', 115" (discussed in much greater detail below) differ from each other in the types of antenna-RRU units 50, 50', 50" they house, along with variations in mounting hardware to accommodate the different antenna-RRU units 50, 50', 50". Hereinafter, for brevity, any discussion to the antenna-RRU module 115 and/or the antenna-RRU unit 50 will be considered equally relevant to the other antenna-RRU modules 115', 115" and/or the antenna-RRU units 50', 50" unless otherwise stated.

Figure 3:
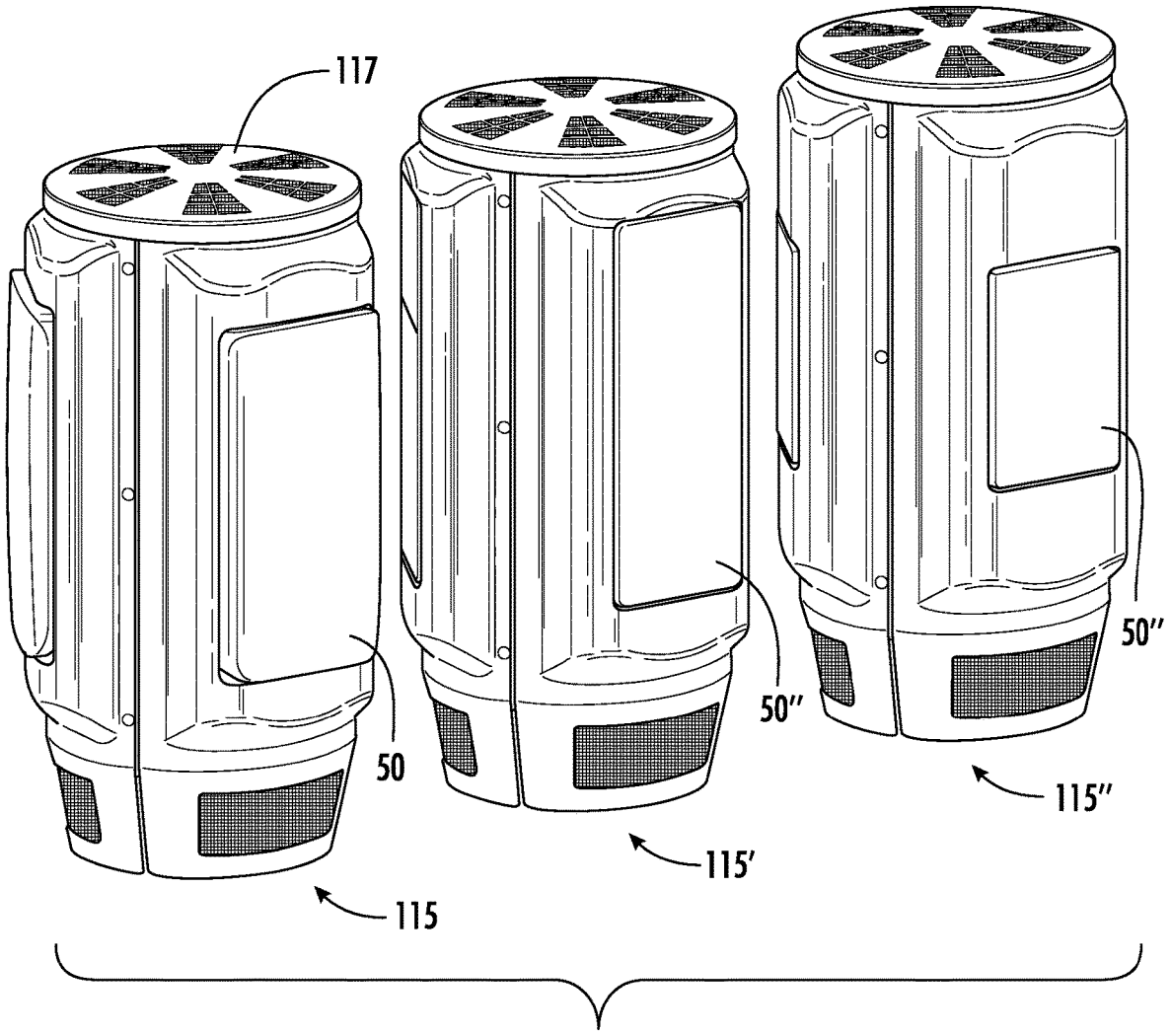
FIG. 3 is a perspective view of the three different antenna-RRU modules shown in FIG. 2.
Figure 6B:
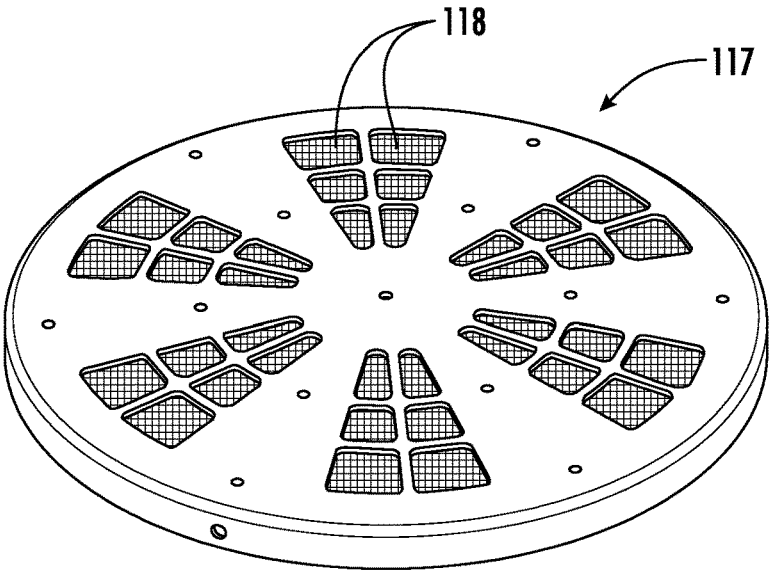
FIG. 6B is a perspective view of a lower end cap for the antenna module of FIG. 6A.

FIG. 3 illustrates an alternative arrangement in which an antenna module 116 is not mounted on the antenna-RRU module 115, and instead each of the antenna-RRU modules 115 is topped with an end cap 117. FIG. 6B shows another view of the end cap 117, which includes perforated areas 118 that permit ventilation from within the antenna-RRU module 115.

Figure 7A:
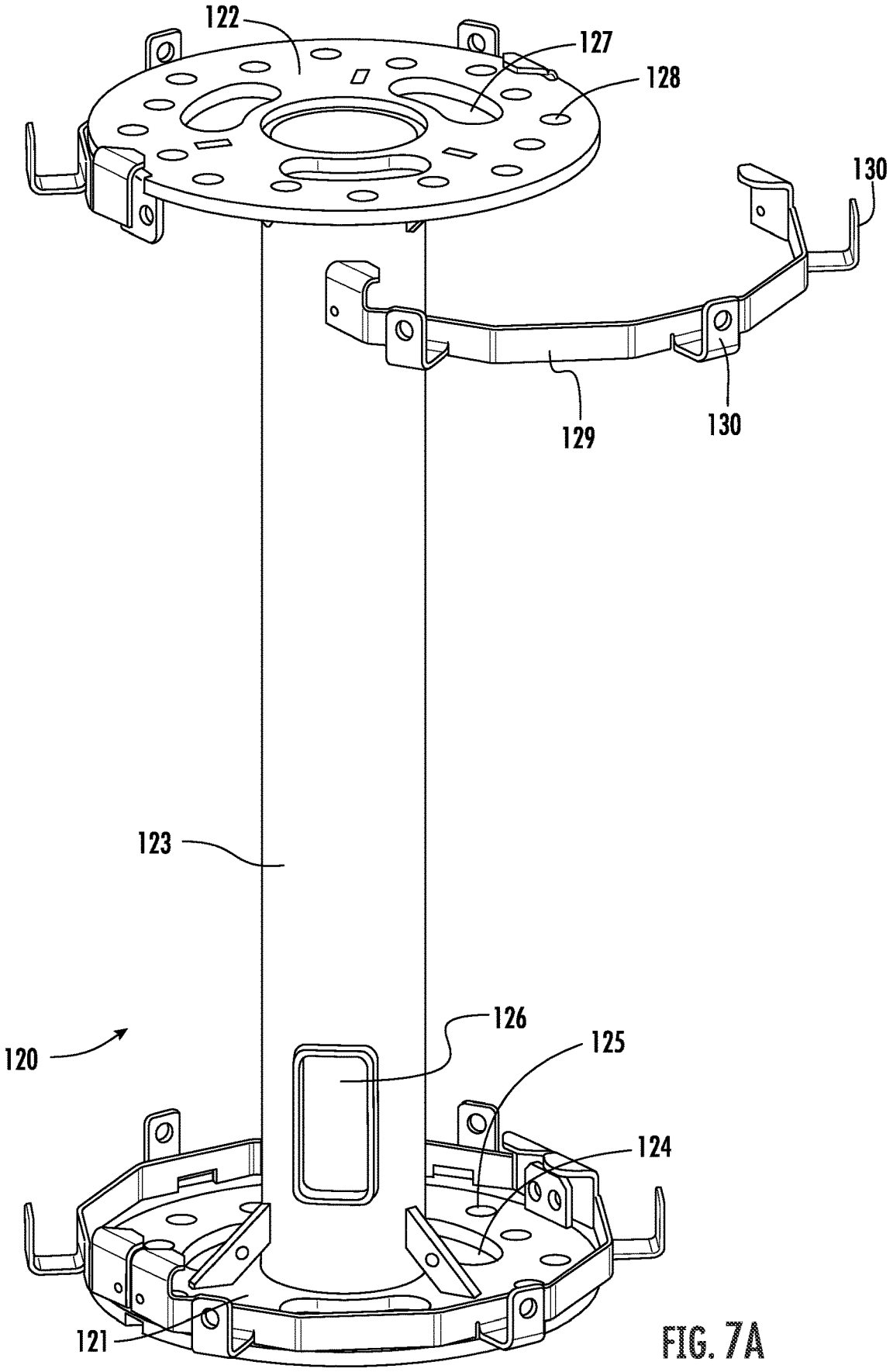
FIGS. 7A and 7B are perspective views of two sizes of spools employed in the antenna-RRU units of FIG. 3.
Figure 7B:
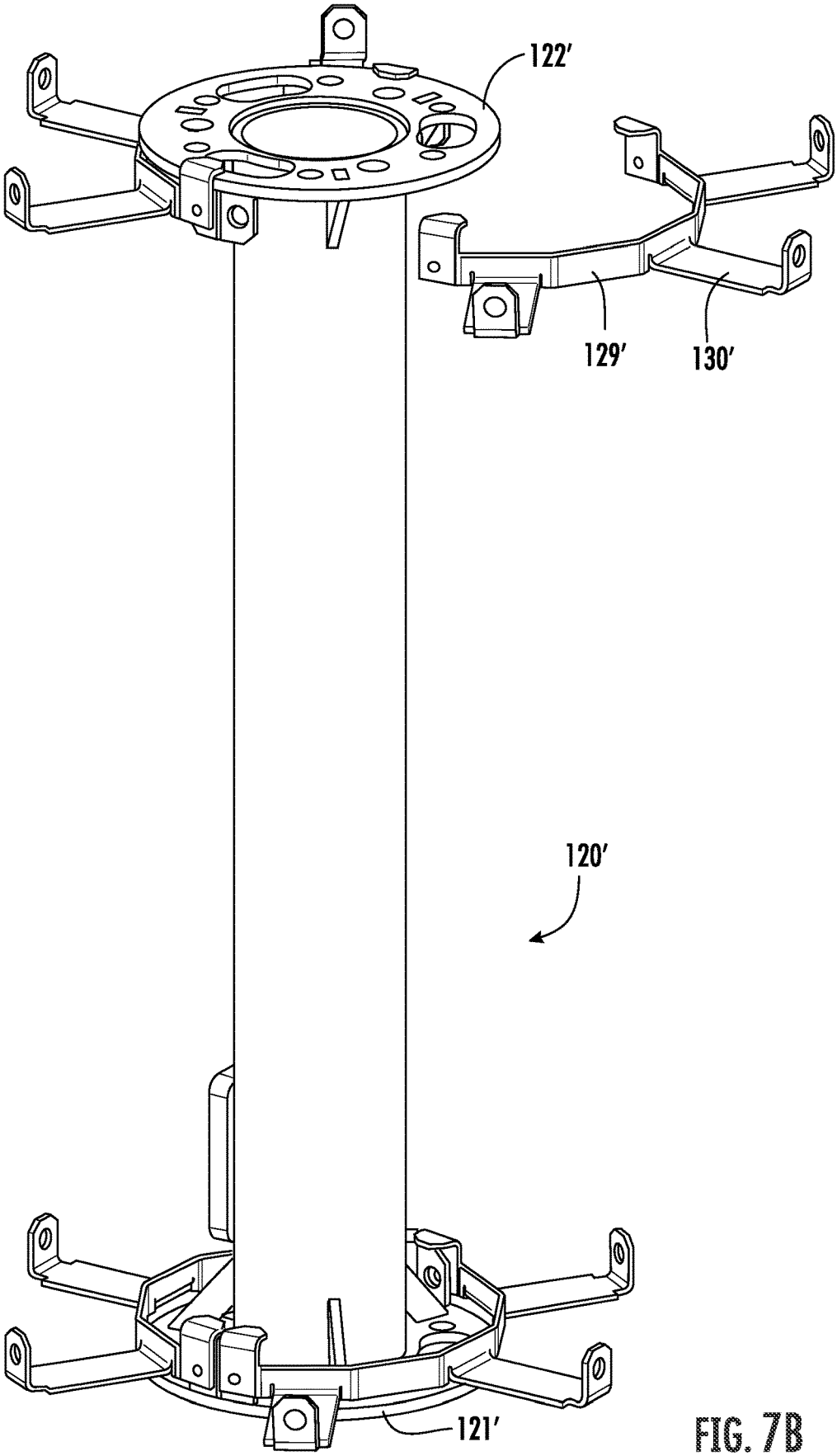

Each module 115 includes three antenna-RRU units 50, three shrouds 20, three sets of hardware for mounting (not visible in FIG. 2 or 3, but shown in FIGS. 8-11C), and a spool 120 (not visible in FIG. 2 or 3, but shown in FIGS. 7A and 7B). These components are discussed below.

The antenna/RRU units 50, 50', 50" are "active-antenna" units, meaning that they are antenna-radio units that comprise both a transmit/receive radio and an antenna in the same unit. The illustrated antenna-RRU units 50, 50', 50" are "5G" units, which are devices that meet the requisite high level of performance and precision to satisfy 5G protocols and performance requirements. Exemplary antenna-RRU units include Model No. At1K0X (available from Samsung—illustrated as antenna-RRU unit 50), Model No. 1281 (available from Ericsson—illustrated as antenna-RRU unit 50'), and Model No. 6701 (also available from Ericsson—illustrated as antenna-RRU unit 50").

Figure 4:
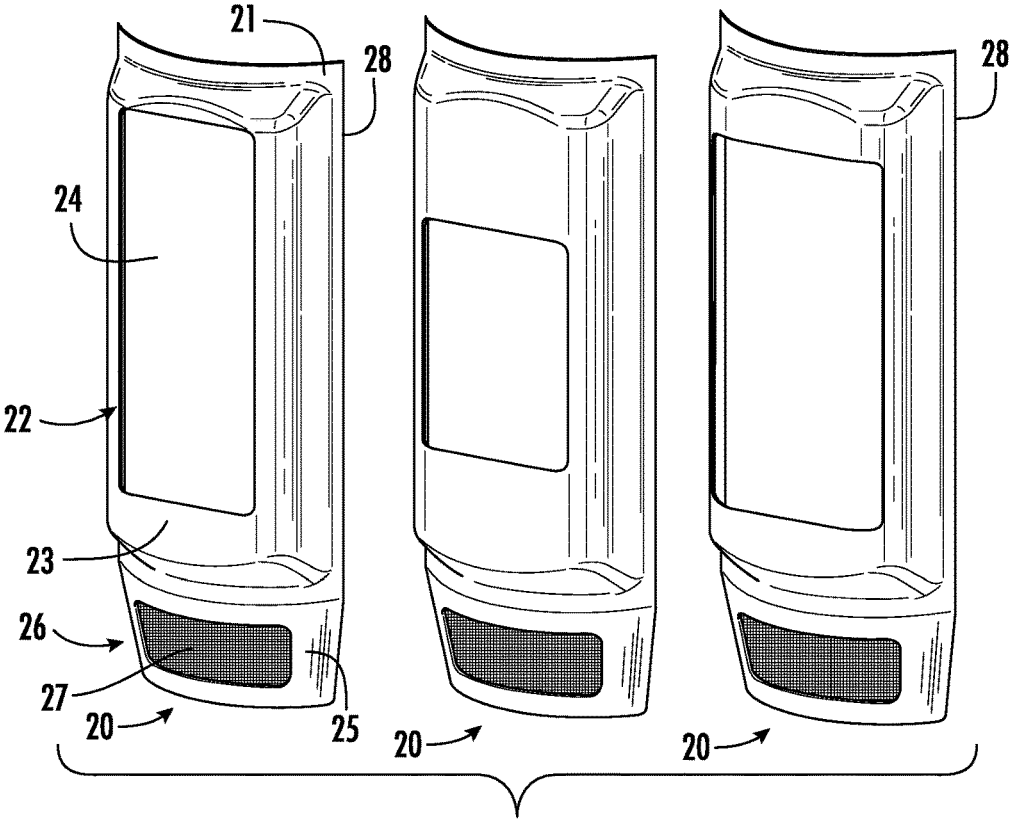
FIG. 4 is a perspective view of the shrouds employed with the antenna-RRU modules of FIG. 3.
Figure 5:
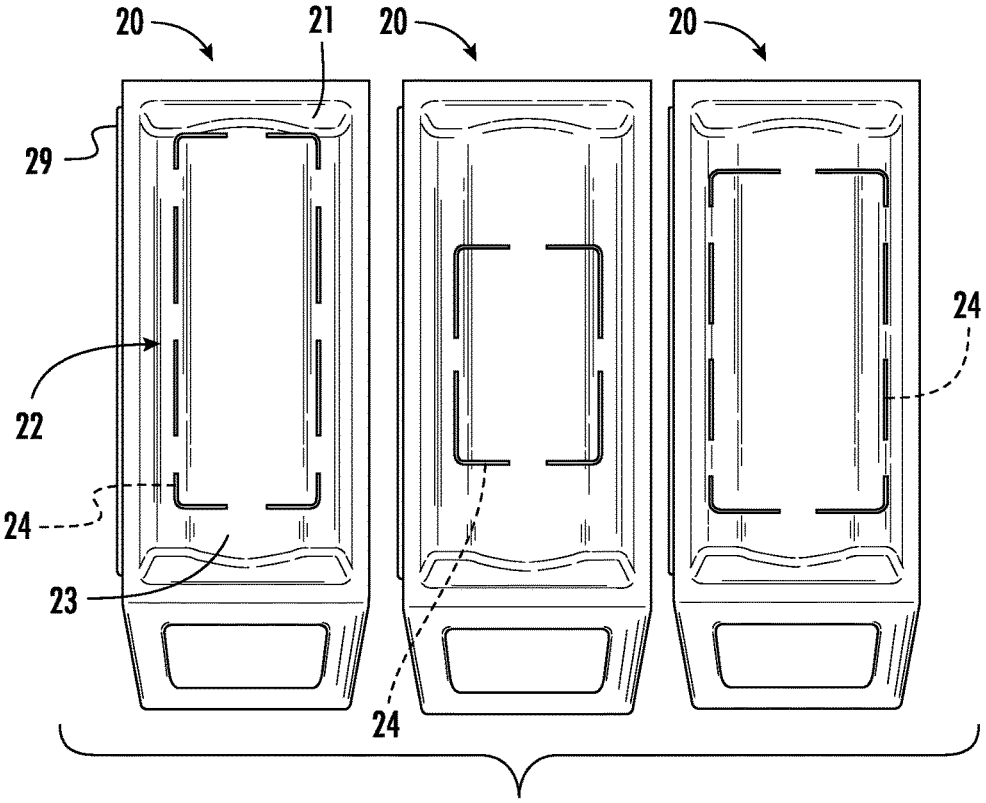
FIG. 5 is a front view of preformed blanks for the shrouds of FIG. 4, with lines indicating cutting locations to form a window for the antenna-RRU units to be housed therein.

Referring now to FIG. 4, the shroud 20 is a unitary body with an arcuate foundation 21 and a compartment 22 that extends forwardly from the foundation 21. The compartment 22 is generally box-shaped, with a flat front wall 23 having a window 24. A tapered lower portion 25 extends downwardly beneath the compartment 22; a vent 26 with a mesh insert 27 is located in the lower portion 25. Mounting holes 28 are located near the periphery of the foundation 21 and on a recessed lip 29 that extends from one side edge. As shown in FIG. 5, the shroud 20 may be formed with a solid front wall 23, with the window 24 of the desired size for a specific antenna-RRU unit being cut into the front wall 23 as a secondary operation.

The shroud 20 may be formed of a polymeric material, such as acrylonitrile-butadiene-styrene (ABS). The edges of the foundation 21 may be configured and/or include features to facilitate bonding, and/or a gasket or O-ring to promote sealing.

Referring now to FIG. 7A, the spool 120 is shown therein. The spool 120 includes a base 121 and a ceiling 122 that are connected by a pole 123. The base 121 includes cable passage apertures 124 and mounting holes 125 that permit attachment of the spool 120 to the monopole beneath. The pole 123 has a vent 126 for directing cooling air into the module 115. The ceiling 122 also has cable passage apertures 127 and mounting holes 128 that enable the ceiling to be connected with either an end cap 117 or an antenna module 116. In addition, two semi-circular mounting bands 129 with tabs 130 are mounted to each of the floor 121 and the ceiling 122 to provide mounting locations for the shrouds 20.

An alternative spool 120' is illustrated in FIG. 7B. The spool 120' has a floor 121' and a ceiling 122' that are smaller in diameter than that floor 121 and ceiling 122 as such, the tabs 130' on the mounting bands 129' are longer than the tabs 130 so that the mounting locations for the shrouds 20 are correctly positioned.

Figure 8:
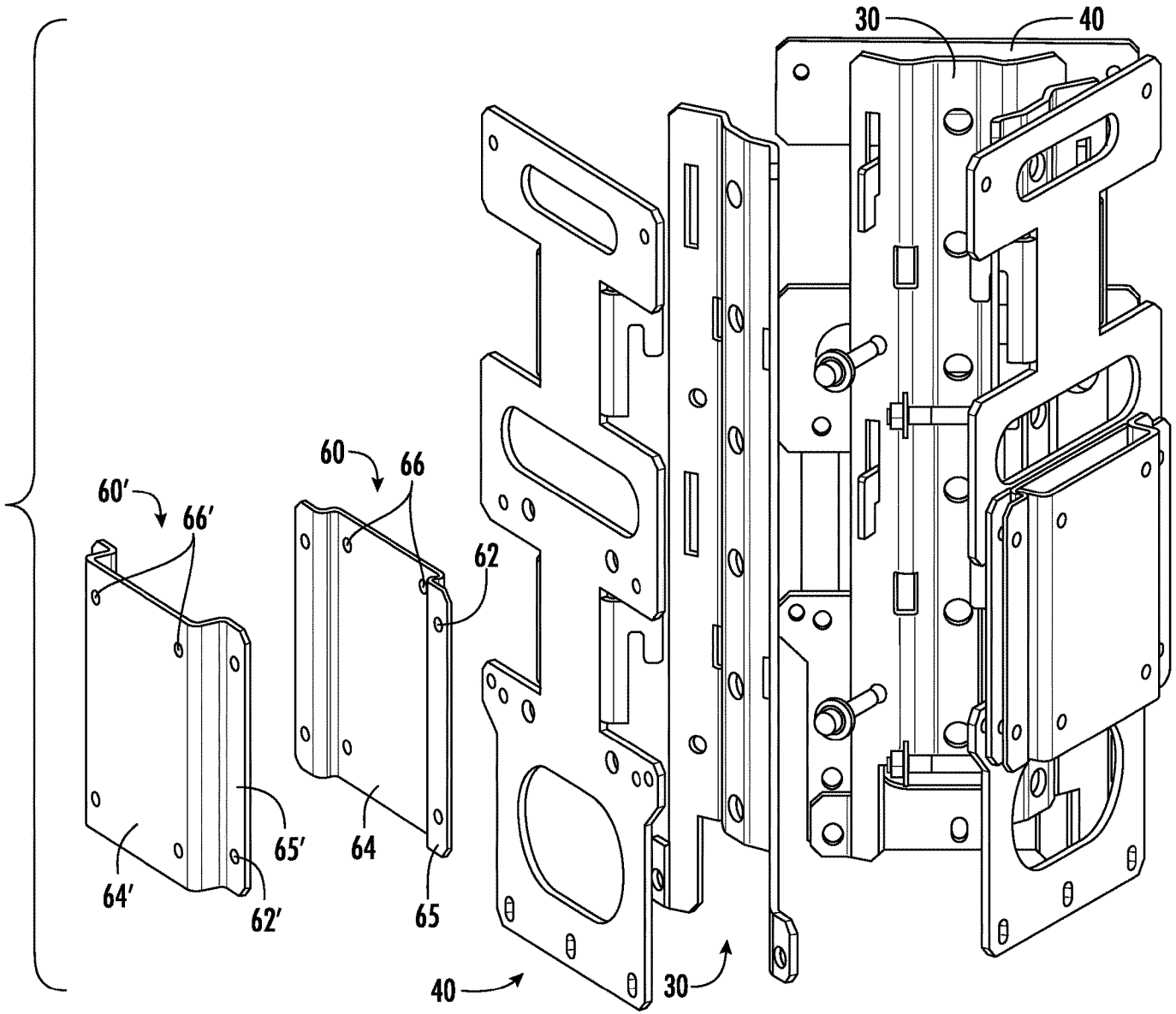
FIG. 8 is an exploded perspective view of mounting hardware used to mount the antenna-RRU units of the antenna-RRU modules of FIG. 3.
Figure 9A:
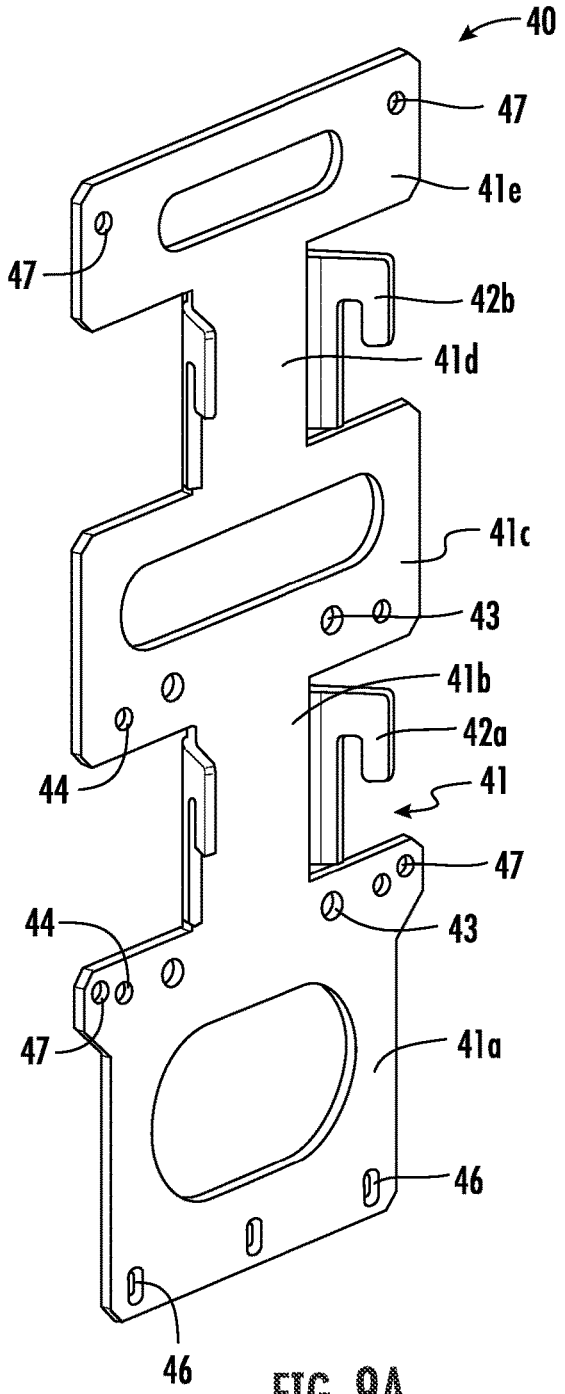
FIGS. 9A and 9B are perspective views of, respectively, the subassembly mounting bracket and the pole mounting bracket of the hardware of FIG. 8.
Figure 9B:
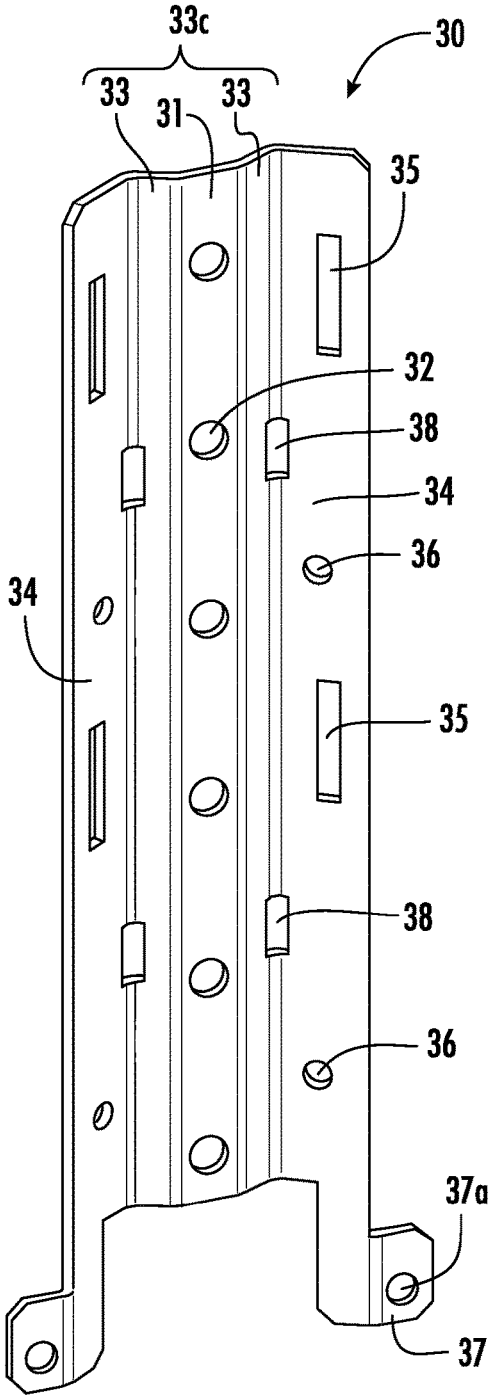

Referring now to FIGS. 8, 9A and 9B, the hardware employed to mount the antenna-RRU units 50 is illustrated therein. The hardware includes a pole mounting bracket 30 (FIG. 9B) and a subassembly mounting bracket 40 (FIG. 9A). These brackets are described in greater detail below.

The pole mounting bracket 30 includes a central strip 31 that includes a plurality of mounting holes 32. A transition strip 33 is attached to each of the side edges of the central strip and extends at an obtuse angle thereto. Together, the central strip 31 and the transition strips 33 form a concave portion 33*c* that is configured to receive the pole 123 of a spool 120. Wings 34 are attached to respective edges of the transition strips 33 and extend at an angle thereto. Each wing 34 includes two vertical slots 35 and two mounting holes 36. A flange 37 with a hole 37*a* extends laterally from the lower end of each wing 34. Two slots 38 are present at each junction between the transition strips 33 and the wings 34.

The subassembly mounting bracket 40 includes a main panel 41 with lower, middle and upper portions 41*a*, 41*c*, 41*e* that are connected by transition sections 41*b*, 41*d*. Lower hooks 42*a* extend from the transition section 41*b*, and upper hooks 42*b* extend from the transition section 41*d*. One set of four mounting holes 44 are positioned on the lower and middle portions 41*a*, 41*c*. Another set of mounting holes 43 is positioned on the lower and middle portions 41*a*, 41*c* inwardly of the holes 44. Finally, holes 46 are present in the lower corners of the lower portion 41*a*, and holes 47 are positioned in the upper corners of the lower and upper portions 41*a*, 41*e*.

FIG. 8 also illustrates two RRU mounting brackets 60, 60', which may be used to mount a specific antenna-radio unit 50, 50', 50". The RRU mount plate 60, which is typically used to mount the antenna-radio unit 50", has a flat main panel 64 with two wings 65 that are parallel to but offset forwardly from the main panel 64. The main panel 64 includes four mounting holes 66 (one in each corner of the main panel 64), and also includes two mounting holes 62 in each wing 65. The RRU mounting plate 60', which is typically used to mount the antenna-RRU unit 50', is similar in configuration, with a flat main panel 64' having holes 66' and wings 65' having holes 62', but is oriented so that the main panel 64' is positioned forwardly of the wings 65' rather than rearwardly. The antenna-RRU unit 50 is typically mounted without an RRU mounting bracket.

Figure 10A:
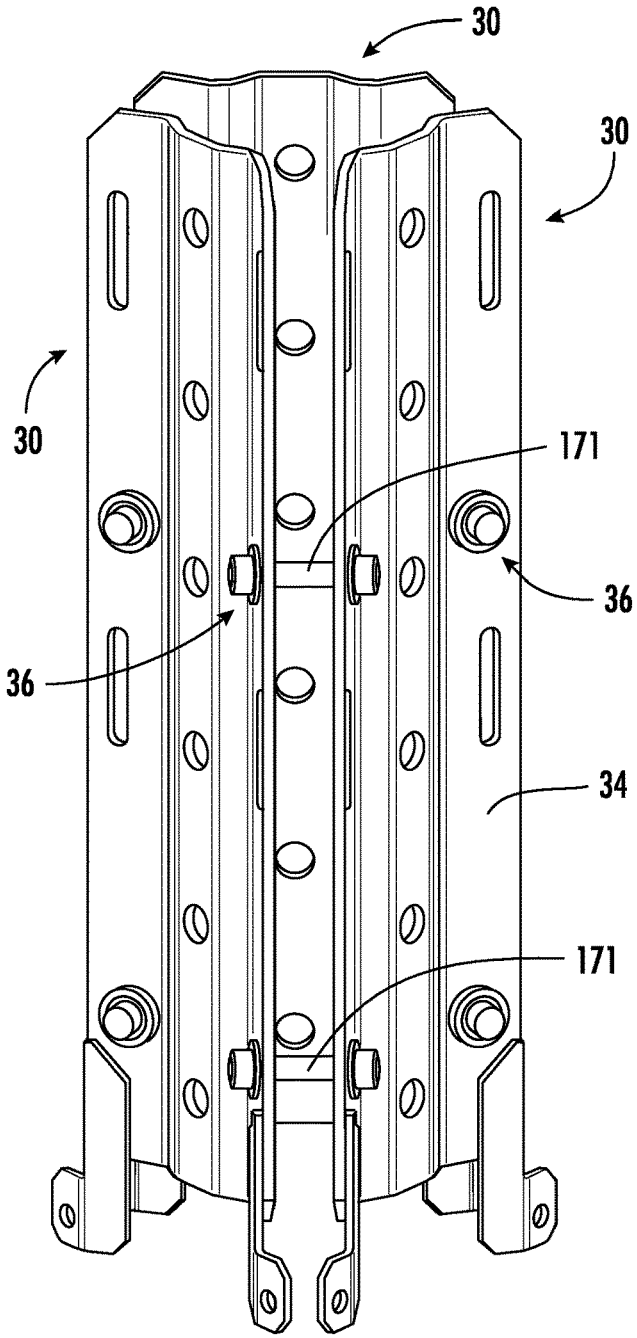
FIG. 10A is a perspective view of three pole mounting brackets of FIG. 9B arranged for mounting on a pole of a spool.
Figure 10B:
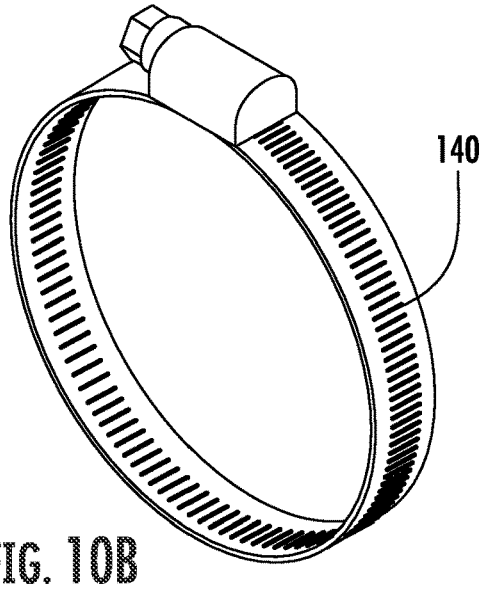
FIG. 10B is a perspective view of an exemplary hose clamp that can be used to mount the pole mounting brackets of FIG. 10A to the pole of a spool.
Figure 11A:
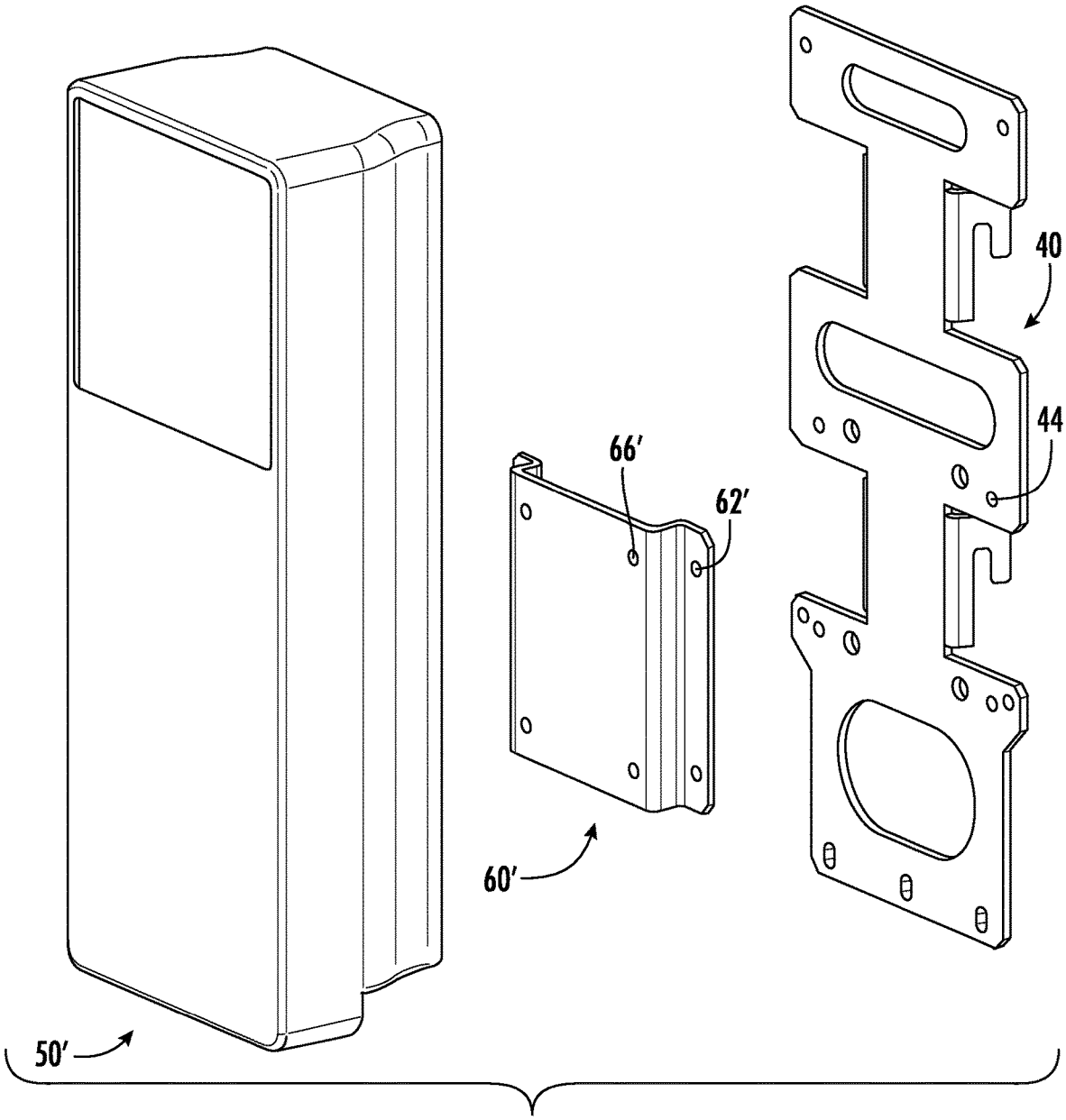
FIG. 11A is an exploded perspective view of an antenna-RRU unit, an RRU mounting bracket, and a subassembly mounting bracket of FIG. 9A.
Figure 11B:
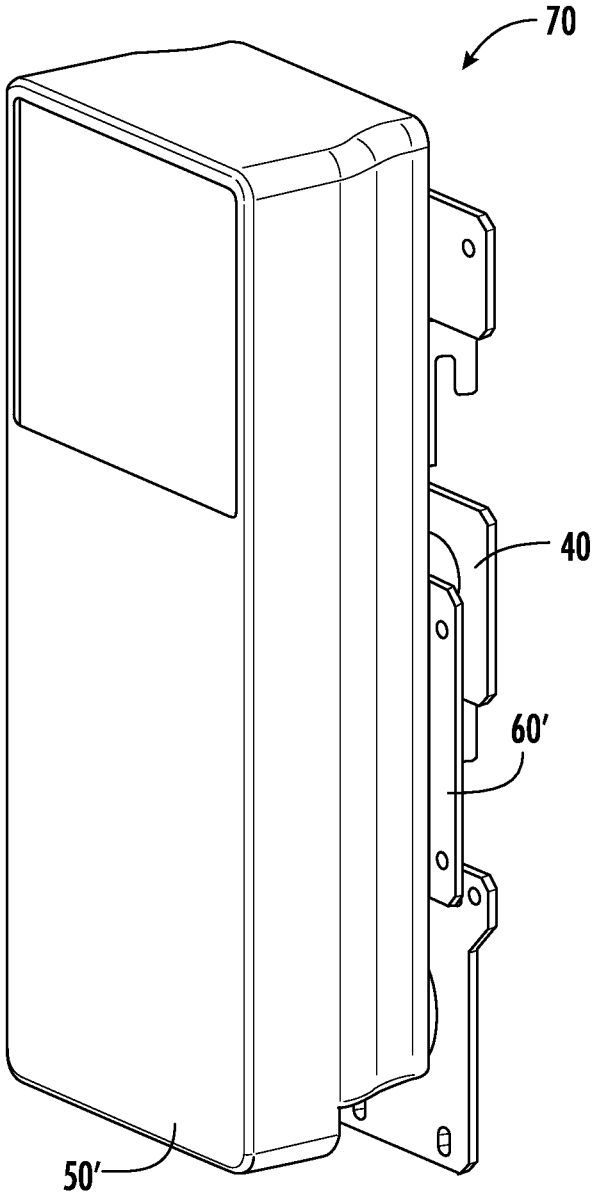
FIG. 11B is an assembled perspective view of the components of FIG. 11A.
Figure 11C:
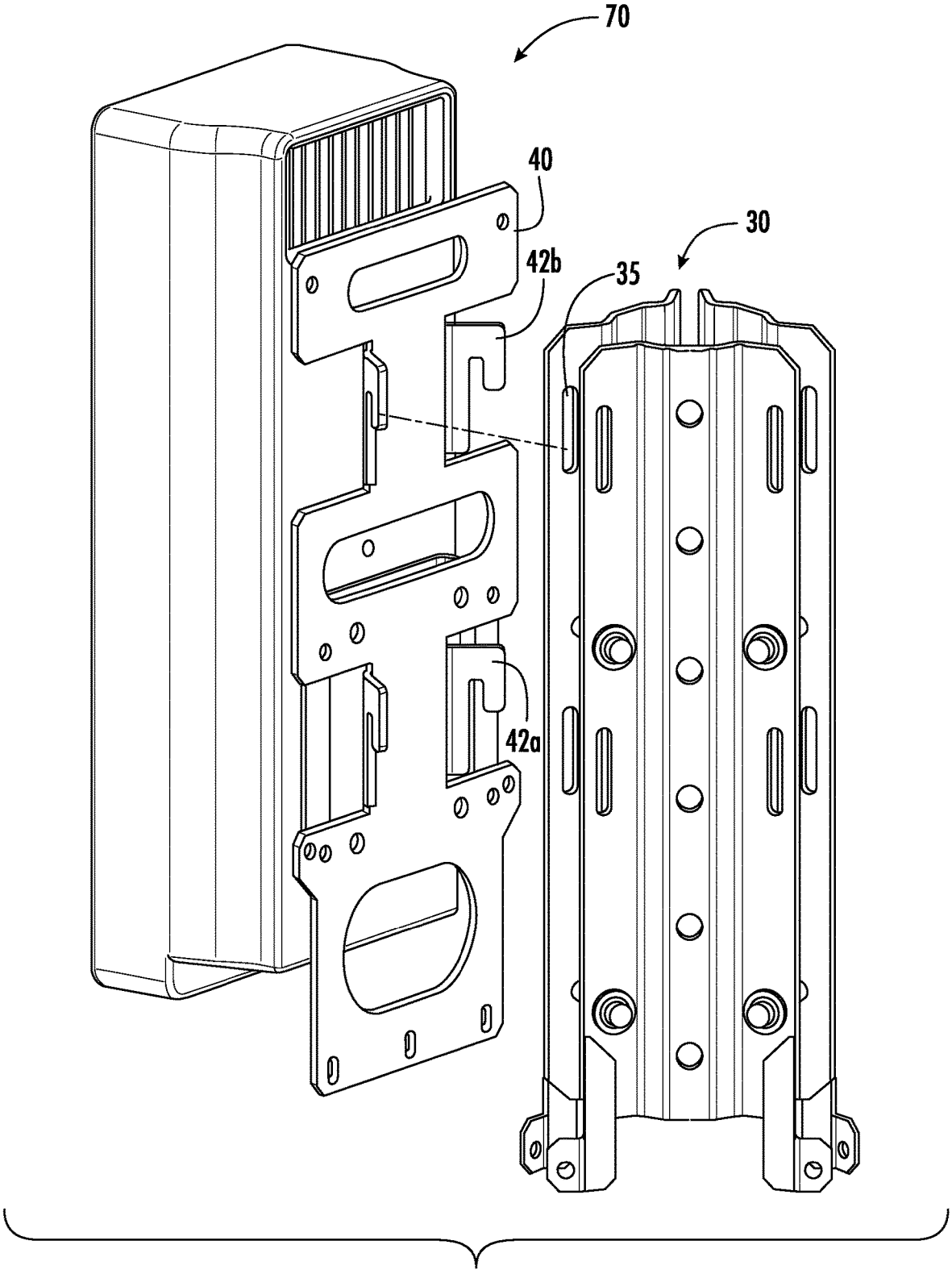
FIG. 11C is an exploded rear perspective view of the assembled components of FIG. 11B to be mounted on one of the pole mounting brackets of FIG. 10A.

As shown in FIG. 10A, three pole mounting brackets 30 can be mounted on the pole 123 of a spool 120. Mounting can be achieved by either (a) threading two hose clamps or other radial clamps 140 (see FIG. 10B) though the slots 38 in each pole mounting bracket 30 to bind the pole mounting bracket 130 to the pole 123, (b) using threaded rods or bolts 171 inserted through the mounting holes 36 in the wings 34 of adjacent pole mounting brackets 30 (this technique is shown in FIG. 10A), or (c) attaching the pole mounting brackets 30 directly to the pole with bolts or the like inserted into the holes 32 in the central strip 31.

Next, one of the antenna-radio units 50 is mounted onto the subassembly mounting bracket 40. In the case of the antenna-RRU unit 50, mounting may be achieved by attaching the subassembly mounting bracket 40 directly to the antenna-RRU unit 50 by inserting screws or bolts into the holes 47. In the case of the antenna-RRU unit 50', mounting is achieved by attaching the RRU mounting bracket 60' to the antenna-RRU unit 50' via screws or bolts inserted into the holes 66', then attaching the subassembly mounting bracket 40 to the RRU mounting bracket 60' via screws or bolts inserted into the holes 44, 62'. In the case of the antenna-RRU unit 50", mounting is achieved by attaching the RRU mounting bracket 60 to the antenna-RRU unit 50" via screws or bolts inserted into holes 62, then attaching the subassembly mounting bracket 40 to the RRU mounting bracket 60' via screws or bolts inserted into holes 66, 43.

Once the subassembly bracket 40 has been attached to the desired antenna-RRU unit 50, that subassembly (designated herein at 70) can be mounted on a pole mounting bracket 30 by inserting the hooks 42*a*, 42*b* on the subassembly mounting bracket 40 into the slots 35 of the pole mounting bracket 30. The process is repeated for all three antenna-RRU units 50 to mount them onto the spool 120 separated from each other by 120 degrees. Each of the subassembly mounting brackets 40 may be secured to its underlying pole mounting bracket 30 by screws or bolts inserted through the holes 46 in the subassembly mounting bracket 40 and the holes 37*a* in the pole mounting bracket 30.

It can be appreciated that the process for mounting the antenna-RRU units 50 is relatively straightforward and simple. The subassemblies 70 can be assembled while on the ground. All three pole mounting brackets 30 can be mounted on the pole 123 of the spool 120, and the subassemblies 70 can be quickly mounted on the pole mounting brackets 30 via the hooks 42*a*, 42*b*. The subassemblies 70 can then be secured to the pole mounting brackets 30 with the screws or bolts as they are supported by the hooks, thereby eliminating the need for the technician to somehow support the subassemblies (which can be heavy) themselves.

Figure 13:
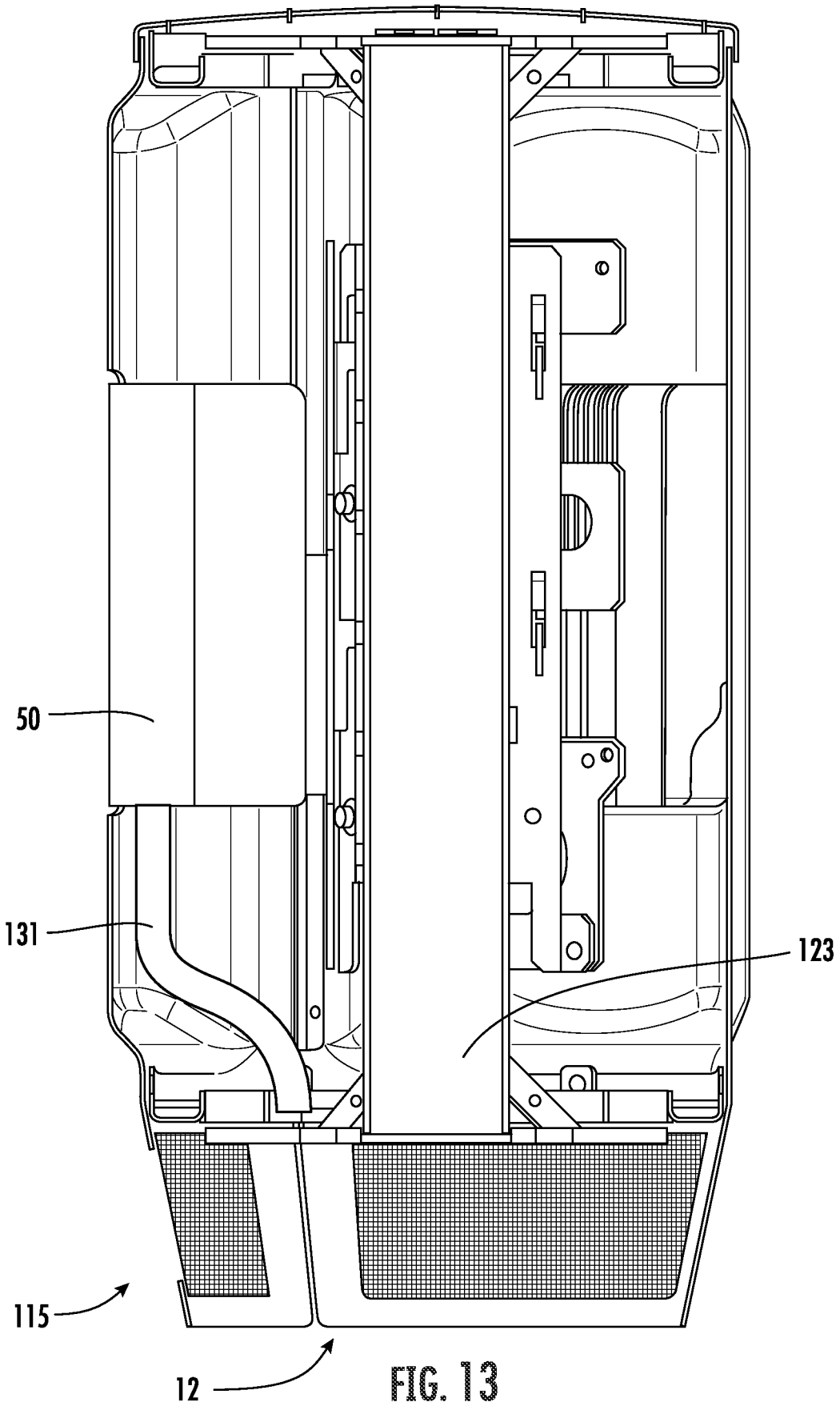
FIG. 13 is a section view of an antenna-RRU module showing the connection of a cable to the antenna-RRU unit.

Once a subassembly 70 has been mounted to the spool 120, cables 131 can be connected to the antenna-RRU unit 50. FIG. 13 shows how a cable 131 can be routed through one of the cable passage apertures 124 in the base 121 of the spool 120 and connected to the antenna-RRU unit 50.

Figure 12:
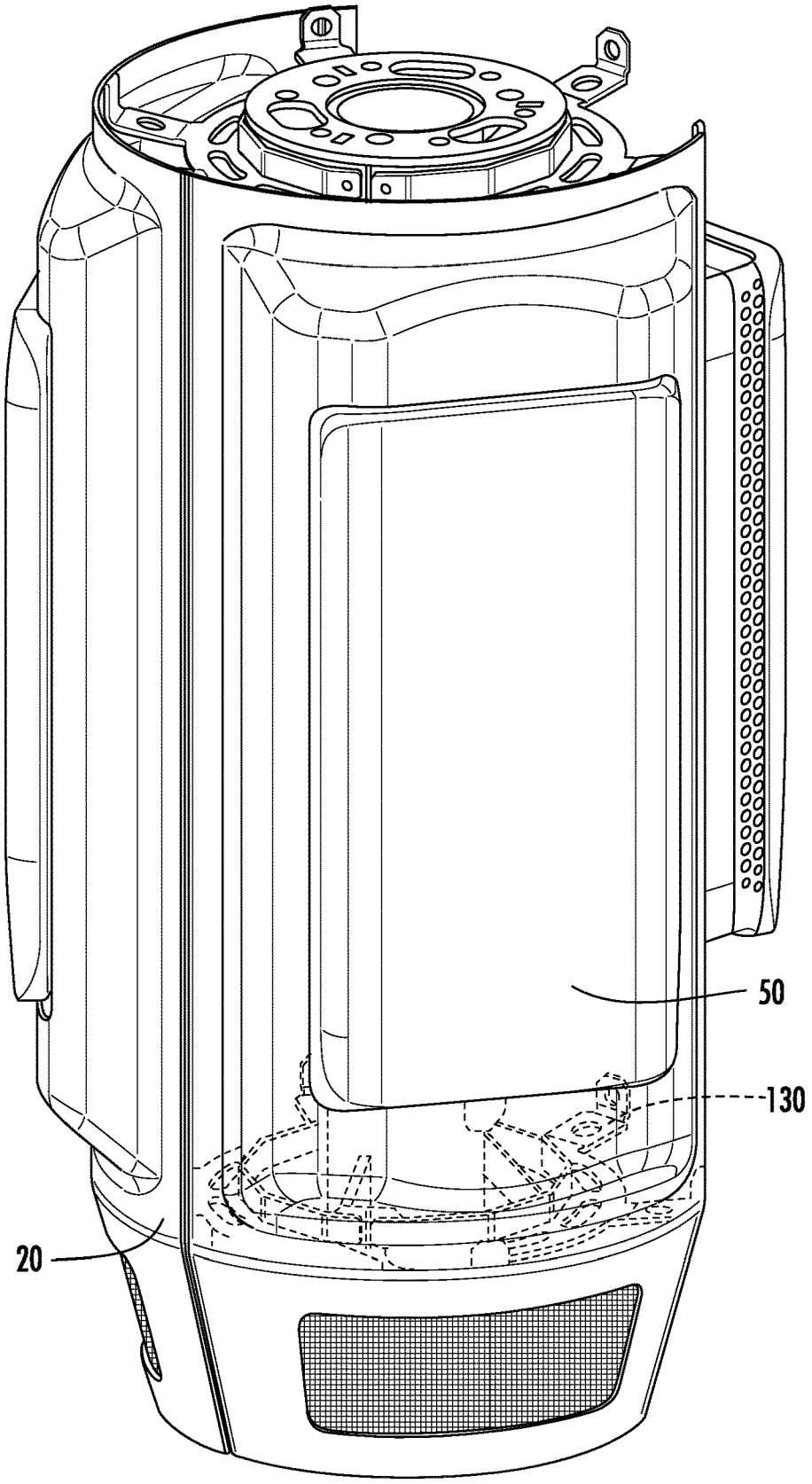
FIG. 12 is a perspective view of three antenna-RRU units mounted on a spool showing the attachment of a shroud of FIG. 4.

Referring now to FIG. 12, once three subassemblies 70 are mounted on the spool 120 and cables 131 are connected, the shrouds 20 can be attached. As shown in FIG. 12, each of the shrouds 20 can be attached to the tabs 130 or 130' of the mounting bands 129, 129' with screws, bolts, rivets or the like. The antenna-RRU unit 50 that is housed within each shroud 20 is positioned so that signals can be transmitted from and received by the antenna-RRU unit 50 through the window 24. Adjacent shrouds 20 can be attached along their side edges, with the lip 29 of one shroud 20 positioned radially inwardly of the side edge of the adjacent shroud 20. When three shrouds 120 are attached to the tabs 130 of the mounting bands 129, the shrouds 20 substantially cover the portion of the module 115 below the end cap 117 or the antenna module 116.

Those of skill in this art will appreciate that the brackets and other hardware shown herein may take different forms, have different configurations, and/or may be interconnected differently. For example, in some embodiments the hooks 42*a*, 42*b* may be position on the pole mounting brackets 30, and the slots 35 positioned in the subassembly mounting brackets 40. Structures other than the tabs 130 on the mounting bands 129 may provide mounting locations for the shrouds. The spool 120 may take a different configuration, and/or make lack one or both of the floor 121 and ceiling 122. Other possibilities are also contemplated.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An antenna-RRU assembly, comprising:

an antenna-RRU unit;

a subassembly mounting bracket fixed relative to the antenna-RRU unit, the subassembly mounting bracket having a plurality of hooks; and a pole mounting bracket having a plurality of vertically-oriented slots;

wherein the hooks of the subassembly mounting bracket are inserted into the slots of the pole mounting bracket to mount the subassembly mounting bracket to the pole mounting bracket.

2. The assembly defined in claim 1, further comprising a shroud that partially encloses the antenna-RRU unit, the shroud including a window through which the antenna-RRU unit can transmit signals.

3. The assembly defined in claim 1, further comprising a spool having a pole, and wherein the pole mounting bracket is mounted to the pole.

4. The assembly defined in claim 1, wherein the pole mounting bracket comprises a concave portion and first and second wings, and wherein the slots are located in the first and second wings.

5. The assembly defined in claim 4, wherein the pole mounting bracket includes a second plurality of slots in the concave portion.

6. The assembly defined in claim 1, wherein the pole mounting bracket includes tabs at a lower end thereof, and wherein the subassembly mounting bracket is secured to the tabs.

7. The assembly defined in claim 1, wherein the subassembly mounting bracket is attached directly to the antenna-RRU unit.

8. The assembly defined in claim 1, wherein the antenna-RRU unit is fixed directly to an antenna-RRU mounting bracket, and wherein the antenna-RRU mounting bracket is fixed directly to the subassembly mounting bracket.

9. An antenna-RRU module for a cellular base station, comprising first, second and third antenna-RRU assemblies mounted on a pole, each of the first, second and third antenna-RRU assemblies comprising:

a pole mounting bracket;

a subassembly mounting bracket mounted on the pole mounting bracket;

an antenna-RRU unit fixed relative to the subassembly mounting bracket; and a shroud mounted to at least partially cover the antenna-RRU unit, wherein the shroud is configured so that a window of a desired size for a specific antenna-RRU unit is formed into the front wall of the shroud;

wherein the pole mounting brackets of the first, second and third antenna-RRU assemblies are mounted on the pole at approximately 120 degree intervals.

10. The module defined in claim 9, wherein the pole is part of a spool having a base and a ceiling.

11. The module defined in claim 10, wherein each of the shrouds is mounted to the spool.

12. The module defined in claim 11, wherein the spool further comprises a mounting band, and wherein each of the shrouds is mounted to the mounting band.

13. The module defined in claim 9, wherein the pole mounting brackets are mounted to the pole with at least one radial clamp.

14. The module defined in claim 9, further comprising fastening members extending between adjacent pole mounting brackets to mount the pole mounting brackets to the pole.

15. The module defined in claim 9, wherein an end cap overlies the ceiling of the spool.

16. The module defined in claim 9, in combination with an antenna module mounted above the antenna-RRU module.

17. The module defined in claim 9, wherein each of the subassembly mounting brackets includes a plurality of hooks, and each of the pole mounting brackets includes a plurality of slots that receive the hooks.

18. The module defined in claim 9, wherein, in each of the first, second and third antenna-RRU assemblies, the subassembly mounting bracket is attached directly to the antenna-RRU unit.

19. The module defined in claim 9, wherein, in each of the first, second and third antenna-RRU assemblies, the antenna-RRU unit is fixed directly to an antenna-RRU mounting bracket, and wherein the antenna-RRU mounting bracket is fixed directly to the subassembly mounting bracket.

20. The module defined in claim 9, wherein the antenna-RRU units are 5G units.

* * * * *